US011377620B2

(12) United States Patent
McQueen

(10) Patent No.: US 11,377,620 B2
(45) Date of Patent: Jul. 5, 2022

(54) ADDITIVE SUPPLEMENTS FOR OIL CHANGES

(71) Applicant: PHILLIPS 66 COMPANY, Houston, TX (US)

(72) Inventor: James Scott McQueen, Houston, TX (US)

(73) Assignee: Phillips 66 Company, Houston, TX (US)

( * ) Notice: Subject to any disclaimer, the term of this patent is extended or adjusted under 35 U.S.C. 154(b) by 0 days.

(21) Appl. No.: 17/317,394

(22) Filed: May 11, 2021

(65) Prior Publication Data

US 2021/0363458 A1 Nov. 25, 2021

Related U.S. Application Data

(60) Provisional application No. 63/028,259, filed on May 21, 2020.

(51) Int. Cl.
*C10M 177/00* (2006.01)
*C10M 169/04* (2006.01)
(Continued)

(52) U.S. Cl.
CPC ..... *C10M 177/00* (2013.01); *C10M 169/04* (2013.01); *F01M 9/02* (2013.01);
(Continued)

(58) Field of Classification Search
CPC ..... C10M 177/00; C10M 169/04; C10M 2203/003; C10M 175/0016;
(Continued)

(56) References Cited

U.S. PATENT DOCUMENTS 4,971,118 A * 11/1990 Cluff ..... B01F 35/80 141/105
5,476,073 A * 12/1995 Betts ..... F02M 55/00 123/73 AD (Continued)

*Primary Examiner* — Ellen M Mcavoy
(74) *Attorney, Agent, or Firm* — Phillips 66 Company

(57) ABSTRACT

A method of producing an additive supplement that when combined with a motor oil licensable with the American Petroleum Institute and the International Lubricant Standardization and Approval Committee creates a second motor oil that meets the standards of the American Petroleum Institute and the International Lubricant Standardization and Approval Committee by first selecting a desired motor oil and a standard motor oil, wherein the desired motor oil comprises a desired base oil component and a desired additive component and the standard motor oil contains a standard base oil component and a standard additive component. A differentiating additive component is produced by determining the additive component differences between the desired additive component and the standard additive component. This differentiating additive component is determined by using equal amounts of the standard motor oil and the desired motor oil. An optional step can then be performed of adding additional additives to the differentiating additive component to produce a preferred additive component. Sufficient base oil is then incorporated to the preferred additive component to produce an additive supplement.

14 Claims, 2 Drawing Sheets

(51) Int. Cl.

| | |
|---|---|
| ***F01M 9/02*** | (2006.01) |
| *C10N 70/00* | (2006.01) |
| *C10N 40/25* | (2006.01) |

(52) U.S. Cl.
CPC ... *C10M 2203/003* (2013.01); *C10N 2040/25* (2013.01); *C10N 2070/00* (2013.01)

(58) Field of Classification Search
CPC ..... C10M 175/0091; F01M 9/02; C10N 2040/25; C10N 2070/00

USPC ..... 508/111; 123/1 A
See application file for complete search history.

(56) References Cited

U.S. PATENT DOCUMENTS

| | | | | |
|---|---|---|---|---|
| 5,885,940 | A * | 3/1999 | Sumimoto | F01M 11/0458 508/111 |
| 5,900,155 | A * | 5/1999 | Bedi | F01M 11/0458 184/6.24 |
| 6,532,918 | B1 * | 3/2003 | Mang | F02M 25/00 123/73 AD |
| 6,938,585 | B2 * | 9/2005 | Schneider | F01M 9/02 123/196 R |
| 7,036,464 | B2 * | 5/2006 | Luther | F16N 19/006 123/196 R |
| 7,828,861 | B1 * | 11/2010 | Wong | C10G 53/02 123/1 A |
| 8,119,579 | B2 * | 2/2012 | Habeeb | C10M 107/10 208/18 |
| 8,468,982 | B2 * | 6/2013 | Johnson | F01M 9/02 700/283 |
| 2013/0333654 | A1 * | 12/2013 | Wedlock | C10M 111/02 208/19 |
| 2018/0112566 | A1 * | 4/2018 | England | F01M 11/0458 |

* cited by examiner

ADDITIVE SUPPLEMENTS FOR OIL CHANGES

CROSS-REFERENCE TO RELATED APPLICATIONS

This application is a non-provisional application which claims the benefit of and priority to U.S. Provisional Application Ser. No. 63/028,259 filed May 21, 2020, entitled "Additive Supplements for Oil Changes," which is hereby incorporated by reference in its entirety.

STATEMENT REGARDING FEDERALLY SPONSORED RESEARCH OR DEVELOPMENT

None.

FIELD OF THE INVENTION

This invention relates to additive supplements for oil changes.

BACKGROUND OF THE INVENTION

Every year, millions of people change the motor oil in their personal vehicle. Whenever a mechanic or an individual changes oil, the first thing which must be done is to purchase the oil. Typically, a vehicle requires four to seven quarts of oil for each oil change either purchased in quart sized bottles or gallon sized bottles. The selection of motor oil to choose from will depend upon the particular vehicle. It is important to choose a motor oil that matches the specifications of your vehicle and is also fully licensed with regulatory agencies to ensure current performance specifications.

For individuals with multiple vehicles or mechanics this could be difficult as there are many different motor oils to select from. From an economical and environmental standpoint, it would be more cost effective for users to purchase larger sized bottles, utilize bag-in-box, or even barrels of motor oil. However larger containers of motor oil only contain one particular type of motor oil and use of that motor oil in all vehicles may cause warranties to be voided.

There exists a need for a method for individuals that provide oil change to utilize one large central container of motor oil that is capable of being used with multiple vehicles.

BRIEF SUMMARY OF THE DISCLOSURE

A method of producing an additive supplement, a motor oil, and a mixture of both the additive supplement and the motor oil, all of which result in a blend that meets current American Petroleum Institute and the International Lubricant Standardization and Approval Committee claims. The method begins by first selecting a desired motor oil and a standard motor oil, wherein the desired motor oil comprises a desired base oil component and a desired additive component and the standard motor oil contains a standard base oil component and a standard additive component. A differentiating additive component is produced by determining the additive component differences between the desired additive component and the standard additive component. This differentiating additive component is determined by using equal amounts of the standard motor oil and the desired motor oil. An optional step can then be performed of adding additional additives to the differentiating additive component to produce a preferred additive component. Sufficient base oil is then incorporated to the preferred additive component to produce an additive supplement.

A method of producing an additive supplement, a motor oil, and a mixture of both the additive supplement and the motor oil, of which the last two meet current American Petroleum Institute and the International Lubricant Standardization and Approval Committee standards. The method begins by selecting a desired motor oil and a standard motor oil, wherein the desired motor oil comprises a desired base oil component and a desired additive component and the standard motor oil contains a standard base oil component and a standard additive component. A differentiating additive component is produced by determining the additive component differences between the desired additive component and the standard additive component. This differentiating additive component is determined using seven quarts of the standard motor oil compared to seven quarts of the desired motor oil. An optional step can then be performed of adding additional additives to the differentiating additive component to produce a preferred additive component. Sufficient base oil is then incorporated to the preferred additive component to produce an additive supplement with a volume of six oz. The additive supplement is then used to change the motor oil in an engine. The step changing the motor oil in an engine involves separately pouring the standard motor oil and the additive supplement into the engine.

BRIEF DESCRIPTION OF THE DRAWINGS

A more complete understanding of the present invention and benefits thereof may be acquired by referring to the follow description taken in conjunction with the accompanying drawings in which.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

Figure 1:
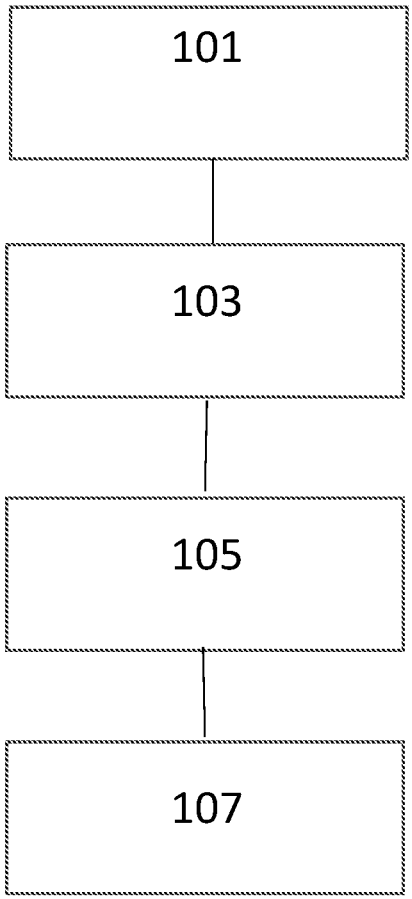
FIG. 1 depicts one embodiment of the method.

In one embodiment, as shown in FIG. 1, the method begins by selecting a desired motor oil and a standard motor oil (101), wherein the desired motor oil comprises a desired base oil component and a desired additive component and the standard motor oil contains a standard base oil component and a standard additive component. A differentiating additive component is produced by determining the additive component differences between the desired additive component and the standard additive component (103). This differentiating additive component is determined by using equal amounts of the standard motor oil and the desired motor oil. An optional step can then be performed of adding additional additives to the differentiating additive component to produce a preferred additive component (105). Sufficient base oil is then incorporated to the preferred additive component to produce an additive supplement (107).

Figure 2:
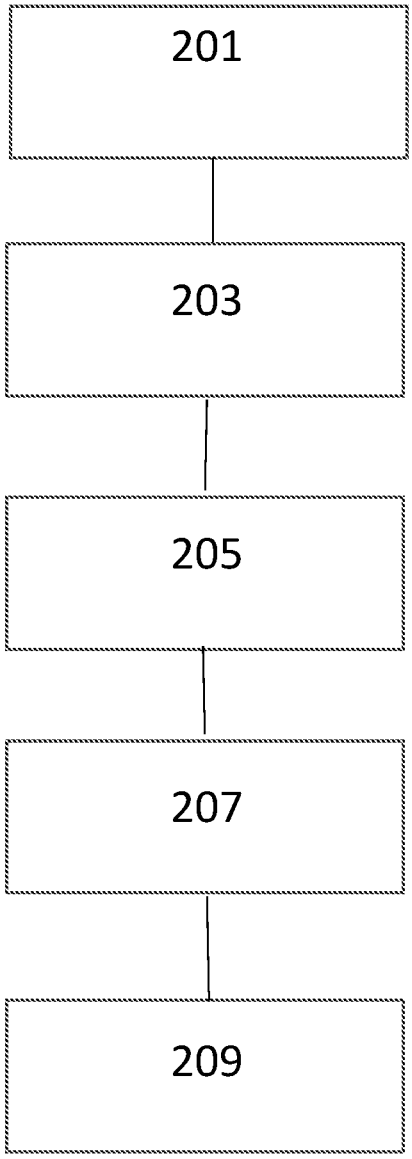
FIG. 2 depicts one embodiment of the method.

In an alternate embodiment, as shown in FIG. 2, the method begins by selecting a desired motor oil and a standard motor oil (201), wherein the desired motor oil comprises a desired base oil component and a desired additive component and the standard motor oil contains a standard base oil component and a standard additive component. A differentiating additive component is produced by determining the additive component differences between the desired additive component and the standard additive component (203). This differentiating additive component is determined using seven quarts of the standard motor oil compared to seven quarts of the desired motor oil. An optional step can then be performed of adding additional additives to the differentiating additive component to produce a preferred additive component (205). Sufficient base oil is then incorporated to the preferred additive component to produce an additive supplement with a volume of six oz (207). The additive supplement is then used to change the motor oil in an engine (209). The step changing the motor oil in an engine involves separately pouring the standard motor oil and the additive supplement into the engine.

It is envisioned that different types of motor oils can be used with the additive components. These include, conventional motor oils, synthetic motor oils, synthetic blend motor oils and high mileage motor oils.

When selecting a desired motor oil and a standard motor oil for use there are different standards that should be paid attention to. These standards can be provided by organizations such as the American Society for Testing and Materials, Japanese Automotive Standards Organization, Association des Constructeurs Europeens d'Automobiles, International Lubricant Standardization and Approval Committee, and the American Petroleum Institute (API).

In one example, API categories such as SJ, SL, SM, SN, and SP can be achieved with the additive supplement. In another example, International Lubricant Standardization and Approval Committee categories such as SAE 0W-20, 5W-20, 0W-30, 5W-30, and 10W-30 viscosity grade oils can be modified with the additive supplement. It is envisioned that once the additive supplement is added to the standard motor oil its performance benefits are improved.

In one embodiment the desired motor oil and the standard motor oil are independently licensable with the American Petroleum Institute and the International Lubricant Standardization and Approval Committee. In an alternate embodiment the solution formed by combining the standard motor oil and the additive supplement, in addition to the standard motor oil and the additive supplement are licensable with the American Petroleum Institute and the International Lubricant Standardization and Approval Committee.

Base Oil Component

In one embodiment both the desired base oil component and the standard base oil component can be any conventionally known base oil component. Base oils are generally classified into different groups, depending on their properties. These properties are in turn influenced by the way in which, and often the degree to which, an oil has been processed. A so-called Group I base oil typically range from amber to golden brown in color due to the sulphur, nitrogen and ring structures remaining in the oil. They typically have a viscosity index (VI) from 90 to 105.

Group II base oils are created by using a hydrotreating process to replace the traditional solvent-refining process. Hydrogen gas is used to remove undesirable components from the crude oil. This results in a clear and colorless base oil with very few sulphur, nitrogen or ring structures. The VI for Group II base oils is typically above 100.

Group III base oils are again created by using a hydrogen gas process to clean up the crude oil, but this time the process is more severe and is operated at higher temperatures and pressures than used for Group II base oils. The resulting base oil is clear and colorless but also has a VI above 120.

Group IV base oils are polyalphaolefin (PAO) synthetic base oils with a VI generally greater than 120.

The final group of base oils are Group V base oils and comprise all base oils not included in Groups I, II, III, or IV. Generally, naphthenic base oils, various synthetic esters, polyalkylene glycols (PAGs), phosphate esters and others fall into this group.

Additive Component

In one embodiment both the desired additive component and the standard additive component can be any conventionally known additive component. Examples of conventionally known additives include, viscosity-index improvers, dispersants, detergents, anti-wear agents, friction modifiers, antioxidants, anti-foam additives, rust inhibitors, corrosion inhibitors, pour-point depressants, emulsifiers, biocides, demulsifiers, tackifiers, and extreme pressure additives.

Generally, for motor oils the composition would be anywhere from around about 50 to about 93 percent by weight base oil and from about 7 to about 50 percent by weight additives. In alternating embodiments, the motor oil composition can be from about 70 to about 85 by weight base oil and from about 15 to about 30 by weight additives.

In one embodiment, the differentiating additive component is produced by determining the additive component differences between the desired additive component and the standard additive component. When determining the differentiating additive component, it is desired that the amount of the desired motor oil to the amount of standard motor oil is the identical. In one embodiment, the amount of differentiating additive component is calculated by comparing four quarts of desired motor oil to four quarts of standard motor oil. In other embodiments, the volume of desired motor oil and standard motor oil, can be four, five, six, seven, eight, nine, ten, eleven, even twelve quarts.

Once the differentiating additive component is generated, optionally, additional additive components can be added to produce a preferred additive component. For example, in one embodiment for high mileage additive supplement additional viscosity-index improvers and/or seal swell additives can be added.

To produce the additive supplement, a specific volume of base oil component is then added to the preferred additive component. The base oil component can be added in an amount necessary to create a 3 oz, 6 oz, or even a 9 oz additive supplement. These volumes would allow the additive supplement to be poured from one pre-packaged single use bottle. For example, a 6 oz bottle can be used to treat from 4-7 quarts of motor oil or 9 oz bottle can be used to treat 8-12 quarts of motor oil.

The additive supplement can then be used to change motor oil in an engine. The method can begin by selecting a desired motor oil or a standard motor oil and separately selection an additive supplement. This motor oil and additive supplement are then separately poured into the engine. In different embodiments, the motor oil can be poured prior to the additive supplement, the motor oil can be poured simultaneously during the pouring of the additive supplement, or the additive supplement can be poured after the motor oil.

In an alternative embodiment, a mechanic or a home consumer would be able to pour the additive supplement from larger container than a single pre-packaged single use bottle. In this embodiment, the volume ratio of the additive supplement to the motor oil or the standard motor oil can be in a ratio from about 3:64 to about 3:112. Alternative ratios can be envisioned based upon the type of additives in the additive supplement.

In one embodiment, the standard motor oil and the additive supplement forms a solution within the engine.

In closing, it should be noted that the discussion of any reference is not an admission that it is prior art to the present invention, especially any reference that may have a publication date after the priority date of this application. At the same time, each and every claim below is hereby incorporated into this detailed description or specification as an additional embodiment of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The invention claimed is:

1. A method comprising the steps of:

selecting a first motor oil and a second motor oil, wherein the first motor oil comprises a first base oil component and a first additive component and the second motor oil contains a second base oil component and a second additive component;

identifying the additive component differences between the first additive component and the second additive component in equal amounts of the second motor oil and the first motor oil, to produce a third differentiating additive component;

adding an optional amount of additive to the third additive component to produce an additive component;

incorporating base oil to the additive component to produce an additive supplement.

2. The method of claim 1, wherein the additive supplement is poured into one pre-packaged single use bottle.

3. The method of claim 1, wherein the additive supplement is used to change the motor oil in an engine.

4. The method of claim 1, wherein the first motor oil and the second motor oil are licensable with the American Petroleum Institute and the International Lubricant Standardization and Approval Committee.

5. A method comprising the steps of:

selecting a first motor oil and a second motor oil, wherein the first motor oil comprises a first base oil component and a first additive component and the second motor oil contains a second base oil component and a second additive component;

identifying the additive component differences between the first additive component and the second additive component in seven quarts of the second motor oil and seven quarts of the first motor oil, to produce a third additive component;

adding an optional amount of additive to the third additive component to produce a preferred additive component; and incorporating sufficient base oil to the additive component to produce an additive supplement with a volume of six oz.

wherein the additive supplement is used to change the motor oil in an engine comprising the steps of:

separately pouring the second motor oil and the additive supplement into the engine.

6. The method of claim 5, wherein the volume ratio of the additive supplement to the second motor oil poured into the engine ranges from about 3:64 to 3:112.

7. The method of claim 5, wherein the second motor oil is dispensed from pre-packed single use bottles.

8. The method of claim 5, wherein the second motor oil is dispensed from a bulk motor oil container.

9. The method of claim 5, wherein the second motor oil and the additive supplement forms a solution within the engine.

10. The method of claim 5, wherein the first motor oil and the second motor oil are licensable with the American Petroleum Institute and the International Lubricant Standardization and Approval Committee.

11. A method comprising the steps of:

selecting a first motor oil and a second motor oil, wherein the desired motor oil comprises a first base oil component and a first additive component and the standard motor oil contains a second base oil component and a second additive component;

identifying the additive component differences between the first additive component and the second additive component in seven quarts of the second motor oil and seven quarts of the first motor oil, to produce a third additive component;

adding an optional amount of additive to the third additive component to produce a additive component; and incorporating sufficient base oil to the additive component to produce an additive supplement with a volume of six oz.

wherein the additive supplement is used to change the motor oil in an engine comprising the steps of:

separately pouring the second motor oil and the additive supplement into the engine;

wherein the mixture of the second motor oil and the additive supplement create the first motor oil that is licensed with the American Petroleum Institute and the International Lubricant Standardization and Approval Committee.

12. The method of claim 8, wherein the second motor oil is poured into the engine prior to the additive supplement.

13. The method of claim 8, wherein the additive supplement is poured into the engine prior to the second motor oil.

14. The method of claim 8, wherein the first motor oil and the second motor oil are licensable with the American Petroleum Institute and the International Lubricant Standardization and Approval Committee.

* * * * *